US006634288B1

(12) United States Patent
Imamaki et al.

(10) Patent No.: US 6,634,288 B1
(45) Date of Patent: Oct. 21, 2003

(54) STAMP MEMBER AND STAMP UNIT USING THE STAMP MEMBER

(75) Inventors: Teruo Imamaki, Nagoya (JP); Takashi Miki, Nagoya (JP); Teruyo Katsuno, Nagoya (JP); Koji Sugiyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/610,881

(22) Filed: Jul. 6, 2000

(30) Foreign Application Priority Data

Jul. 6, 1999 (JP) ..... 11-192403
Jul. 6, 1999 (JP) ..... 11-192404
Sep. 8, 1999 (JP) ..... 11-254077

(51) Int. Cl.[7] ..... B41N 1/24

(52) U.S. Cl. ..... 101/125; 101/128.21; 101/128.4; 101/405; 101/333

(58) Field of Search ..... 101/327, 401.1, 101/125, 128.21, 128.4, 333, 128.1, 405, 406

(56) References Cited

U.S. PATENT DOCUMENTS 3,315,601 A 4/1967 Borack
4,961,377 A * 10/1990 Bando et al. ..... 101/128.21
4,986,175 A * 1/1991 Boehringer et al. ..... 101/125
5,160,564 A * 11/1992 Hasegawa et al. ..... 156/231
5,303,647 A * 4/1994 Seo et al. ..... 101/125
5,577,444 A * 11/1996 Toyama ..... 101/379
5,586,500 A * 12/1996 Takami et al. ..... 101/327
5,816,160 A * 10/1998 Taira et al. ..... 101/405
5,829,352 A * 11/1998 Taira et al. ..... 101/327
5,899,142 A * 5/1999 Suda et al. ..... 101/125
5,915,299 A * 6/1999 Kuriyama et al. ..... 101/128.21
5,996,493 A * 12/1999 Okumura et al. ..... 101/333
6,042,922 A * 3/2000 Senoo et al. ..... 428/66.6
6,050,183 A * 4/2000 Tanaka et al. ..... 101/128.21
6,092,461 A * 7/2000 Tanaka et al. ..... 101/128.21
2001/0008666 A1 * 7/2001 Soproni ..... 428/40.1

FOREIGN PATENT DOCUMENTS

DE 17 86 370 B 6/1971
EP 0 899 118 A1 3/1999
JP A-4-363285 12/1992
JP A-11-78912 3/1999

* cited by examiner

*Primary Examiner*—Leslie J. Evanisko
*Assistant Examiner*—Kevin D. Williams
(74) *Attorney, Agent, or Firm*—Oliff & Berridge, PLC

(57) ABSTRACT

A stamp member 11 includes a porous resin 101 and a film 103 adhered together by an acrylic adhesive 102. The film 103 is peeled from the porous resin 101 after stamp making operations have been completed for forming a stamp image on a stamp surface 71 of the porous resin 101. Therefore, the stamp surface 71 of the porous resin 101 is protected from fine dirt and dust. Also, because there is no need to proved a film between a stamp making device and the stamp member 11 at stamp making operations, stamp making operations are simplified.

4 Claims, 17 Drawing Sheets

STAMP MEMBER AND STAMP UNIT USING THE STAMP MEMBER

BACKGROUND OF THE INVENTION

1. Field of the Invention

The present invention relates to a stamp member and a stamp unit that uses the stamp member, and relates particularly to a stamp member having a porous resin formed with ink-permeable portions and ink-non-permeable portions in its surface by stamp making processes and to a stamp unit that uses such a stamp member.

2. Description of Related Art

Japanese Patent-Publication Application Publication (Kokai) No. HEI-4-363285 (Japanese Patent No. 2853754) discloses a conventional stamp unit shown in FIG. 29. As shown in FIG. 29, the stamp unit includes a stamp member 80 and a holder 83, both formed from the same material, such as polypropylene resin. The stamp member 80 is formed from a porous material through which ink can permeate. The stamp member 80 includes a stamp portion 81 and a non-stamp portion 82 formed around the stamp portion 81. The stamp portion 81 is permeable to ink and formed with characters, symbols, figures, and the like in a protruding shape. The non-stamp portion 82 is formed lower than the stamp portion 81 and is sealed by heat so as not to be permeable to ink.

The holder 83 holds ink and has an opening for letting ink to flow therethrough. The non-stamp portion 82 and a peripheral edge 84 of the holder 83 are fused together by a thermal plate that has been heated to a temperature of 120° C. to 180° C. and hardened thereafter. In this way, the stamp member 80 and the holder 83 are sealed together so that ink is prevented from leaking.

In order to seal the stamp member 80 and the holder 83 together by thermal fusion as described above, the non-stamp portion 82 need to have a certain width, about 2 mm. This non-stamp portion 82 becomes a margin where no characters are formed during stamping. If the margin becomes large, then it is difficult to precisely align the stamp portion 81 with a desired area of a recording sheet for a stamping operation. As a result, the stamped image may be shifted from the desired area.

Further, it is difficult to precisely position the stamp member 80 onto the holder 83. When the stamp member 80 is stuck on the holder 83 without using some sort of positioning means, the stamp member 80 and the holder 83 may be shifted out of alignment as shown in FIG. 30 It is conceivable to enclose the stamp member 80 inside the holder 83, so that the holder 83 itself serves as a guide member shown in FIG. 31. However, in this case, the holder 83 will surround the periphery of the non-stamp portion 82, so that the margin around stamped images becomes further undesirably large.

Japanese Patent-Application Publication (Kokai) No. HEI-11-78191 discloses a stamp producing device that produces a stamp unit by forming a stamp face on a stamp member of the stamp unit. The stamp member is made from a lower layer and an upper layer, and is supported on a holder. The lower layer is made from a soft porous resin, such as urethane, dispersed with a light energy absorbing material, such as carbon black. The upper layer is made from a hard porous resin that serves to store ink and also apply uniform pressure onto the lower side layer. The stamp producing device forms ink-permeable portions and ink-non-permeable portions in the surface of the lower layer by stamp making processes.

The stamp producing device includes a thermal head and a xenon tube. The thermal head prints characters and images in a transparent original film using a transfer ribbon, thereby preparing a positive original. The holder is set in the stamp producing device such that the lower layer of the stamp member is in confrontation with and pressed against the positive original.

Then, the xenon tube is illuminated. Light from the xenon tube passes through the positive original and illuminates portions of the lower layer of the stamp member. The illuminated portions of the lower layer correspond to the transparent portions of the positive original. The light energy absorbing material heats up illuminated portions of the lower layer, so that illuminated portions fuses and then harden. As a result, these portions of the lower layer are sealed, so that ink cannot pass therethrough. On the other hand, portions of the lower layer that have not been illuminated by the light correspond to printed portions of the positive original, that is, characters and the like printed in the transparent original film. The non-illuminated portions of the lower film remain in their initial condition without being sealed, so that ink can pass therethrough. In this way, the lower surface of the stamp member is formed with ink-non-permeable portions and ink-permeable portions. When a stamp unit with such a stamp member is pressed against a paper sheet during stamp printing, ink exudes out of the stamp unit through only the ink-permeable portions and clings to the paper sheet, thereby stamping a desired character and the like.

A stamp member can formed with a stamp face by, not only a of flash light using the above xenon tube, but also by a thermal head with electrically driven thermal elements or by a thermal press with a heated thermal plate. The heated thermal plate has protrusions and indentations on its surface that correspond to a stamp image.

When forming a stamp face on a stamp member using the flash of light in the above-described manner, it is desirable to interpose a transparent film between the stamp member and the positive original in order to prevent the portions of the porous resin in confrontation with the printed portions of the positive original from being melted and fused by heat transmitted through the printed portions of the positive original, and also to prevent the positive original from sticking to the melted porous resin.

With the thermal head stamp and thermal press stamp making also, it is desirable to perform stamp making with a film interposed between the stamp member and the thermal head or the thermal plate in order to prevent the stamp member and the thermal head or the thermal plate from sticking together. Therefore, stamp producing devices for thermal head stamp making or thermal press stamp making are also configured to have such a film holding mechanism.

SUMMARY OF THE INVENTION

It is conceivable to support a film directly on the holder, or to provide a separate mechanism for supporting a film between the holder and the stamp making configuration.

However, providing such a conceivable film holding mechanism has the following problems. First, a film must be attached to the mechanism for each stamp. This would make operations complicated. Also, the film would need to be larger than the stamp surface area, so that the mechanism can properly hold the film. Since more film is used than essentially necessary for its function of stick prevention, material cost would be higher than needed. Also, providing such a separate mechanism for supporting a film would complicate the configuration of the stamp producing device.

Further, in these cases, the porous resin would be exposed until stamp making is performed. Therefore, dust and dirt would easily cling to the surface of the porous resin before stamp making. As a result, the stamp member would have degraded stamp image quality. Moreover, if thermal head stamp making were performed, the film, which is not adhered to the porous resin, could slip out of place, so that a clear stamp image would sometimes not be obtained.

It is an objective of the present invention to solve the above-described problems, and to provide a stamp member, and a stamp unit using the stamp member, capable of preventing a porous resin form sticking using less film without requiring complicated operations.

It is also objective of the present invention to provide a stamp member, and a stamp unit with a stamp member, capable of preventing dirt and dust from clinging to the porous resin of the stamp member.

It is another objective of the present invention to provide a stamp member, and a stamp unit that uses the stamp member, that enables a stamp producing device to have a relatively simple configuration.

It is still a further objective of the present invention to provide a stamp member, and a stamp unit using the stamp member, capable of obtaining clear stamp images by thermal head stamp making processes without substantial slippage between the porous resin and a film.

It is still another objective of the present invention to provide a stamp unit wherein a stamp member is easily and precisely positioned with respect to a holder when producing the stamp unit, thereby reducing a margin of a stamped image and enabling a user to easily align the stamp unit with a target stamp area on a recording sheet.

In order to achieve the above and other objectives, there is a stamp member that have its surface formed with ink-permeable portions and ink-non-permeable portions, including a porous resin having a surface, and a film adhered to the surface of the porous resin for protecting the surface, the film being separable from the porous resin without damaging the surface of the porous resin.

There is also provided a stamp unit including a stamp member and a support member that supports the stamp member, the stamp member having a porous resin having a surface, and a film adhered to the surface of the porous resin for protecting the surface, the film being separable from the porous resin without damaging the surface of the porous resin.

There is further provided a stamp unit producing method of producing a stamp unit comprising the steps of (a) attaching a film on a surface of a porous resin, (b) forming a stamp face on the surface of the porous resin to form ink-permeable portions and ink-non-permeable portions, and (C) peeling the film from the surface of the porous resin.

DETAILED DESCRIPTION OF THE PREFERRED EMBODIMENTS

Next, preferred embodiments of the present invention will be described while referring to the accompanying drawings.

Figure 1:
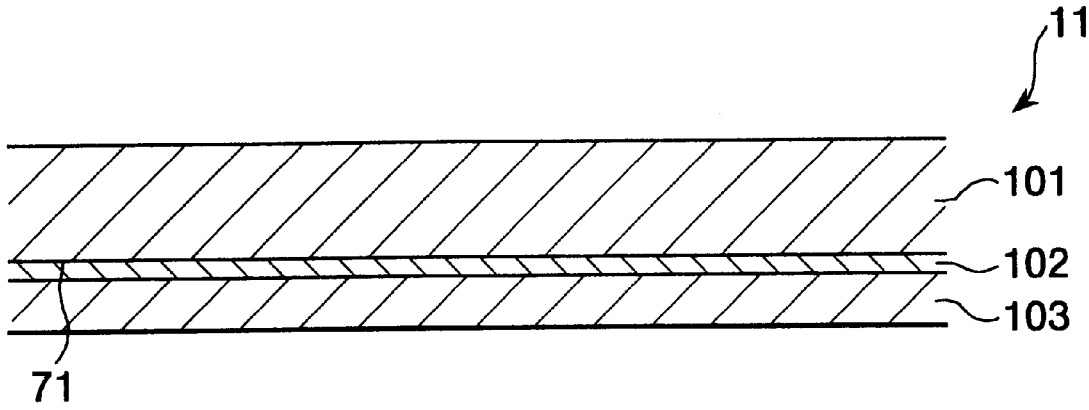
FIG. 1 a cross-sectional view of a stamp member according to a first embodiment of the present invention.

First, a stamp member 11 of the present embodiment will be described while referring to FIG. 1. As shown in FIG. 1, the stamp member 11 is formed by adhering a porous resin 101 to a film 103 using adhesive 102. The stamp member 11 is a member which has not been out to a tamp size and has a relatively large surface area.

The porous resin 101 is a urethane soft resin, such as polyurethane. The urethane resin has a porous rate of about 65% and is dispersed therethrough with light energy absorbing material, such as carbon black. The porous resin 101 has a thickness of about 1.2 mm. The weight ratio of carbon black included in the porous resin 101 is normally 0.1% by weight to 15% by weight and desirably 1.0% by weight to 15% by weight when the porous resin 101 is formed of polyurethane. It should be noted that copper chloride or silver bromide and the like can be used as the light energy absorbing material in the porous resin instead of carbon black. Also, the main ingredient of the porous resin 101 can be rubber resin, polyvinyl chloride (PVC) resin, polyolefine resin instead of the urethane resin.

The film 103 is a transparent or semitransparent film formed from polyethylene terephthalate (PET), PVC resin, polyethylene nephthalate (PEN) resin or the like to a thickness of about 100 $\mu$m to 150 $\mu$m. The thickness of the film 103 is desirably 50 $\mu$m or greater. It should be noted that if the thickness is not sufficiently large, thermal insulating capability of the film 103 during stamp making is undesirably decreased. However, if the thickness is excessively large, the film 103 will defract light emitted for stamp making, so that desirable stamp making cannot be performed. The film 103 is peeled off from the porous resin 101 after stamp making.

The adhesive 102 is an acrylic having a thickness of about 5 $\mu$m to 50 $\mu$m. It is desirable that the adhesive 102 have a peeling force of between 0.001 kgf/cm$^2$ and 0.75 kgf/cm$^2$. It should be noted that peeling force is the force required to peel a 1 cm$^2$ area of the film 103 from the porous resin 101. By setting the peeling force of the adhesive 102 to 0.75 kgf/cm$^2$ or less, the surface of the porous resin 101 can be reliably prevented from being damaged when peeling the film 103 from the porous resin 101. Therefore, a high quality stamp image can be obtained, and ink leakage can be prevented. Also, by setting the peeling force of the adhesive 102 to 0.001 kgf/cm$^2$ or greater, the film 103 can be prevented from accidentally and undesirably separating from the porous resin 101.

Also, it is desirable that the adhesive 102 be an acrylic adhesive. This is because acrylic adhesive is appropriate for long term storage. That is, even after the stamp member 11 with the porous resin 101 and the film 103 adhered with the acrylic adhesive is stored for a long period of time, the peeling force of the acrylic adhesive does not increase more than a certain value. Also, even after a long period of storage, acrylic adhesive will not clog up the porous resin 101. Therefore, ink can smoothly flow through the porous resin 101. However, as long as the above-described conditions are satisfied, other types of well-known adhesive, such as rubber adhesive, can be used instead of acrylic adhesive.

It is also desirable that adhesive 102 not remain on the porous resin 101 when the film 103 is peeled off from the porous resin 102. With this configuration, there is no need to perform operations for removing residual adhesive from the surface of the porous resin 101.

Fine dust and dirt can easily cling to porous surfaces of a porous resin. Moreover, once dust or dirt cling to the porous surfaces, it is difficult to remove it from the surfaces. However, according to the present invention, because the film 103 is adhered to the porous resin 101, a porous stamp surface 71 of the porous resin 101 is protected by the film 103 until the film 103 is peeled off after stamp making. Therefore, dust or dirt will almost never cling to the stamp surface 71 of the porous resin 101. Accordingly, degradation of the stamp image by dust or dirt can be prevented.

Also, because the film 103 is adhered to the porous resin 101, there is no need to adhere a film to the lower attachment surface of a stamp making device when forming a stamp face on the stamp member 11. This simplifies stamp making operations. Further, the surface area of the film 103 need only be the same as the surface area of the stamp surface 71 of the porous resin 101, that is, only the minimum surface area of film 103 is required. Accordingly, production costs can be lowered.

It should be noted that when preparing the stamp member 11, the adhesive 102 is coated on the film 103 using a well-known coating device. Afterwards, the film 103 and the porous resin 101 are laminated on each other. For increasing production efficiency, it is desirable to adhere the porous resin 101 and the film 103 together at a stage wherein both have a relatively large surface area. However, both can be adhered together after being cut into the final stamp size.

Next, a stamp unit 1 including the above-described stamp member 11 will be explained. In this example, the stamp unit 1 is a circular stamp for use as a personal seal.

Figure 2:
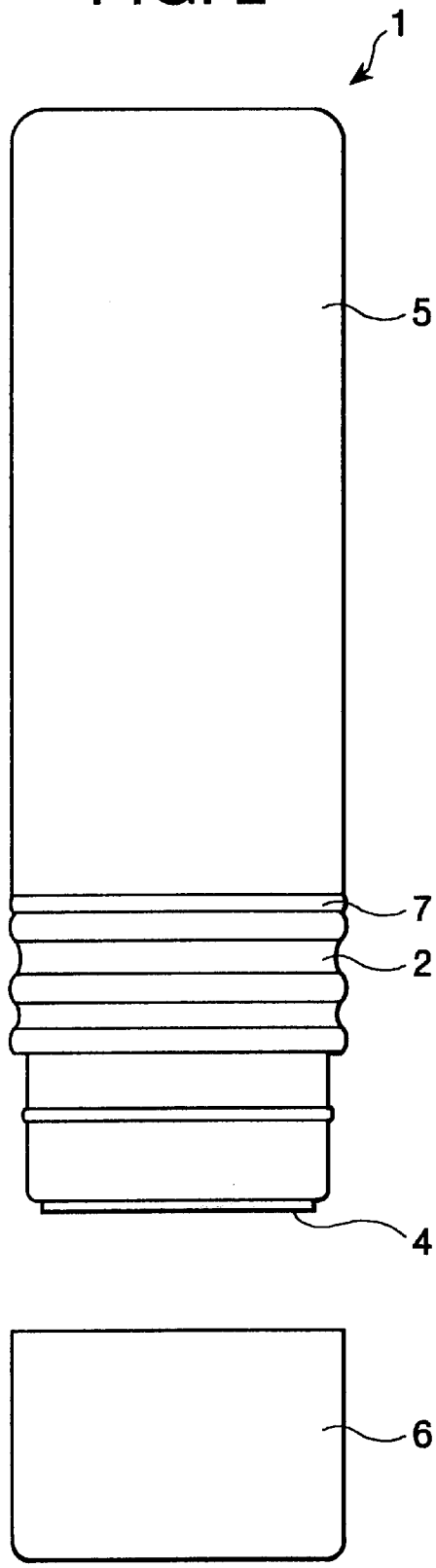
FIG. 2 is a plan view of a stamp unit including the stamp member of FIG. 1.
Figure 3:
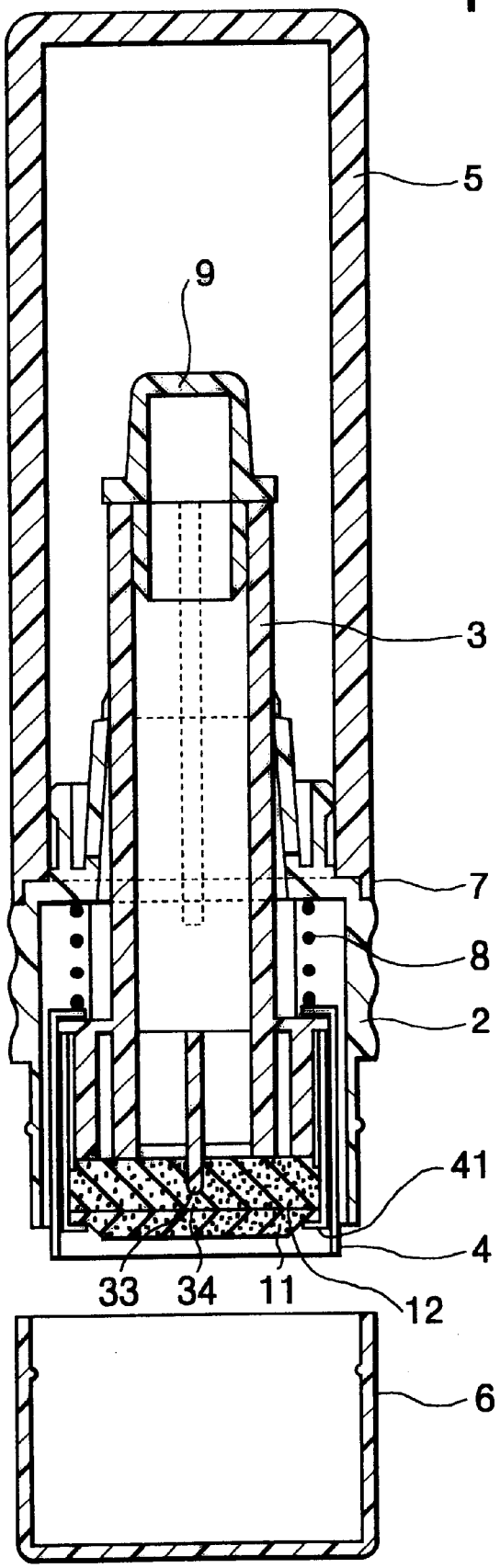
FIG. 3 is a cross-sectional view of the stamp unit of FIG. 2.

As shown in FIGS. 2 and 3, the stamp unit 1 includes a sub-holder 2, a main holder 3, a skirt 4, a grip 5, a lid 6, a ring 7, an ink cap 9, and a press-fit cap 41. The sub-holder 2 serves as a grasping portion and a support for the stamp unit 1 overall during stamping operations. The main holder 3 supports the stamp member 11 and an ink absorbing storage body 12 at its lower end. The skirt 4 is disposed in the sub-holder 2 and is capable of vertical sliding movement with respect to the main holder 3. The grip 5 is engaged with the main holder 3, and presses the main holder 3 downward during stamping. The lid 6 is for covering the stamp member 11. The ring 7 is formed from aluminum and serves as a decoration provided between the sub-holder 2 and the grip 5.

Figure 4:
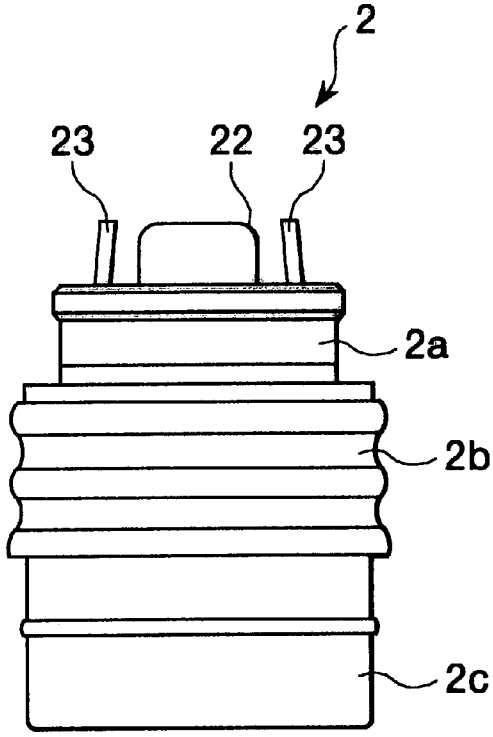
FIG. 4 is a side view of a sub-holder of the stamp unit.
Figure 5:
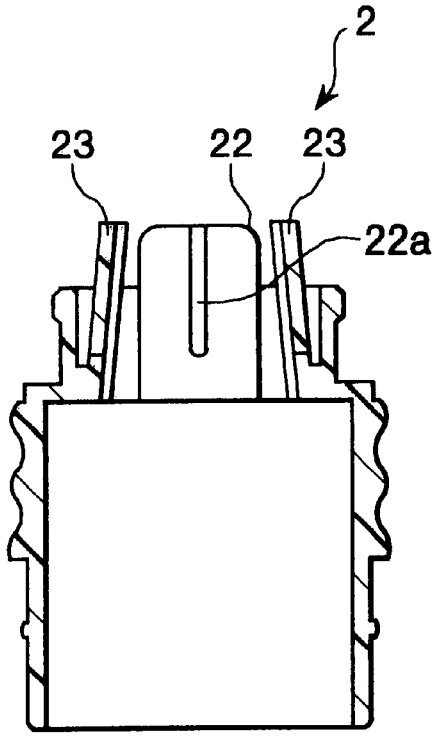
FIG. 5 is a cross-sectional view of the sub-holder.

Next, the sub-holder 2 will be further described while referring to FIGS. 4 and 5. The sub-holder 2 is formed from polybutylene terephthalate (PBT) resin. As shown in FIG. 5, the sub-holder 2 has a flanged cylindrical shape and a substantially cylindrical hollow interior for receiving and supporting the main holder 3. As shown in FIG. 4, the sub-holder 2 has an upper sub-holder 2*a*, a middle sub-holder 2*b*, and a lower sub-holder 2*c*.

The upper sub-holder 2*a* is provided with a pair of left and right support walls 22 and a pair of front and rear support walls 23 for sandwichingly holding the main holder 3. Only one of the pair of front and rear holding walls 22 is shown in FIGS. 4 and 5. The support walls 22 are formed with a protruding portion 22*a* that faces interior of the upper sub-holder 2*a*. The upper sub-holder 2*a* supports the main holder 3 and engages with the interior of the grip 5 as shown in FIG. 3. The middle sub-holder 2*b* has protrusions and recesses for preventing slippage when the user grasps the stamp unit 1. The lower sub-holder 2*c* guides a vertical movement of the skirt 4.

Figure 6:
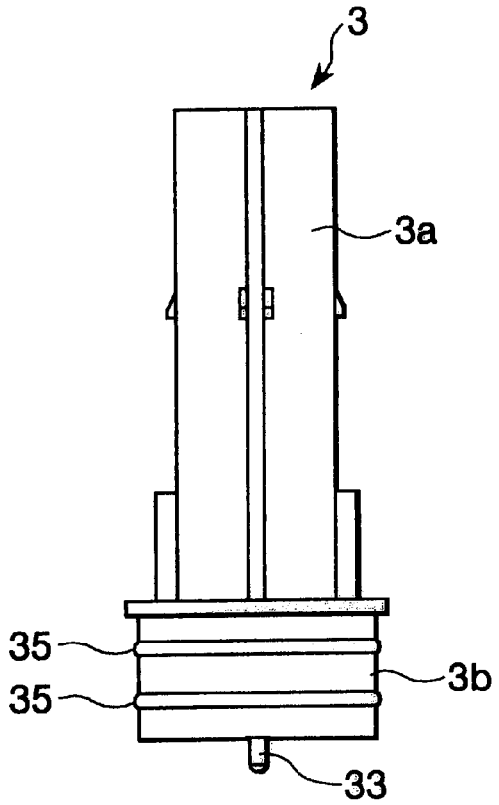
FIG. 6 is a side view of a main holder of the stamp unit.
Figure 7:
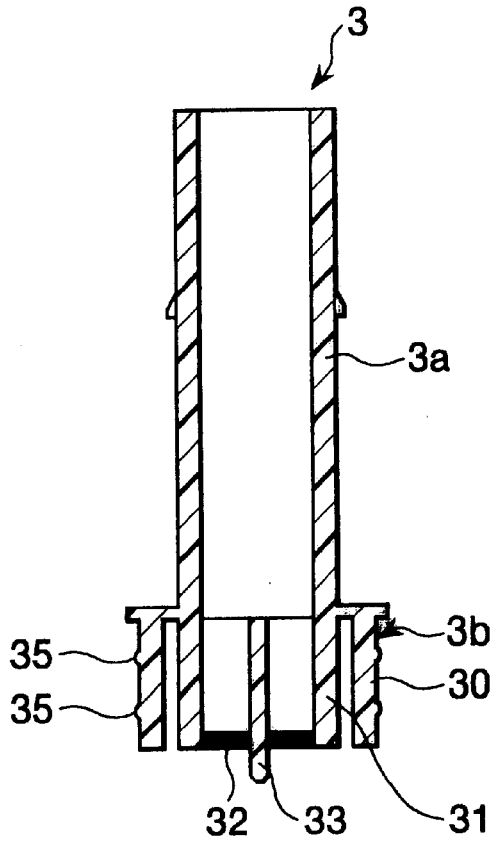
FIG. 7 is a cross-sectional view of the main holder.
Figure 8:
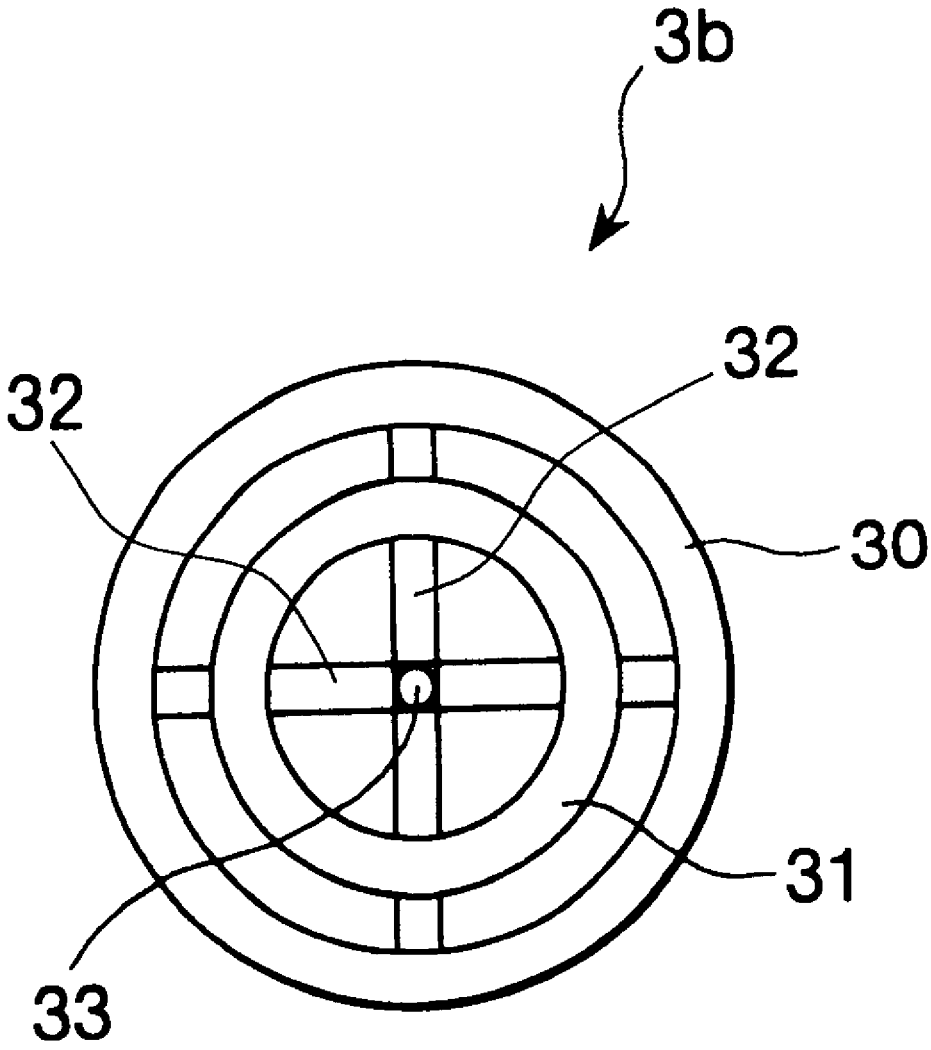
FIG. 8 is a bottom view of the main holder.

Next, the main holder 3 will be further explained while referring to FIGS. 6 to 8. As shown in FIGS. 6 and 7, the main holder 3 has a cylindrical upper main holder 3*a* and a cylindrical lower main holder 3*b*. A diameter of the lower main holder 3*b* is set greater than a diameter of the upper main holder 3*a*. The upper main holder 3*a* stores ink in its hollow interior.

As shown in FIGS. 7 and 8, the lower main holder 3*b* has a peripheral wall 30, a cylindrical wall 31 with a hollow cylindrical shape inside the peripheral wall 30, and plate shaped supports 32 disposed in a cross shape. The cylindrical wall 31 and the supports 32 have an empty space therebetween. A protrusion 33 is provided in the center at the bottom of the lower main holder 3*b*.

The peripheral wall 30 of the lower main holder 3*b* is formed with a pair of packing portions 35 that protrude radially. The packing portion 35 can be formed integrally with the lower main holder 3*b*. Alternatively, the packing portion 35 can be a silicon rubber O-ring or a flexible resin O-ring mounted on the lower main holder 3*b*.

The skirt 4 is placed on a recording sheet (not shown) during stamping and supports the stamp unit 1 overall on the recording sheet. The skirt 4 is formed from stainless steel and supported within the sub-holder 2 so as to be slidable upward and downward relative to the main holder 3. As shown in FIG. 3, a spring 8 is provided inside the middle sub-holder 2*b*. The spring 8 constantly urges the skirt 4 downward.

The grip 5 is formed from PBT resin to a cylindrical shape with the upper end closed. When the grip 5 is pressed towards the recording sheet while the skirt 4 is placed on the recording sheet, the spring 8 is compressed and the skirt 4 is pushed inside of the lower sub-holder 2*c*. When the stamp surface 71 of the stamp member 11 abuts against the recording sheet, stamping is performed.

Figure 9:
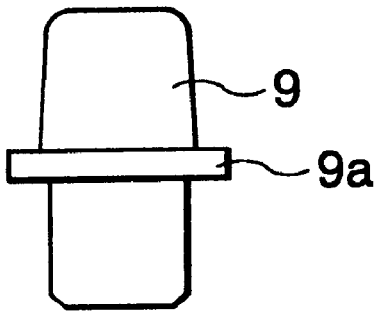
FIG. 9 is a side view of an ink cap of the stamp unit.
Figure 10:
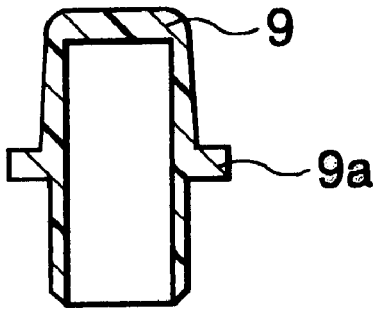
FIG. 10 is a cross-sectional view of the ink cap.

Next, the ink cap 9 will be described while referring to FIGS. 9 and 10. As shown in FIG. 10, the ink cap 9 is a cylindrical shaped cap with a hollow center. The ink cap 9 is formed from polypropylene resin, and is detachably fitted on the upper main holder 3*a* to prevent leakage and drying out of ink stored in the upper main holder 3*a*. As shown in FIGS. 9 and 10, a radial flange 9*a* is formed near the center of the ink cap 9. The flange 9*a* abuts against the upper portion of the main holder 3 as shown in FIG. 3. When it becomes necessary to be replenish ink in the main holder 3, the grip 5 and the sub-holder 2 shown in FIG. 3 are separated from each other and the ink cap 9 is removed. Then, ink can be introduced into the main holder 3.

Figure 11:
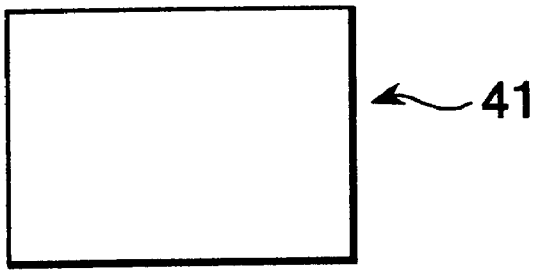
FIG. 11 is a side view of a press-fit cap of the stamp unit.
Figure 12:
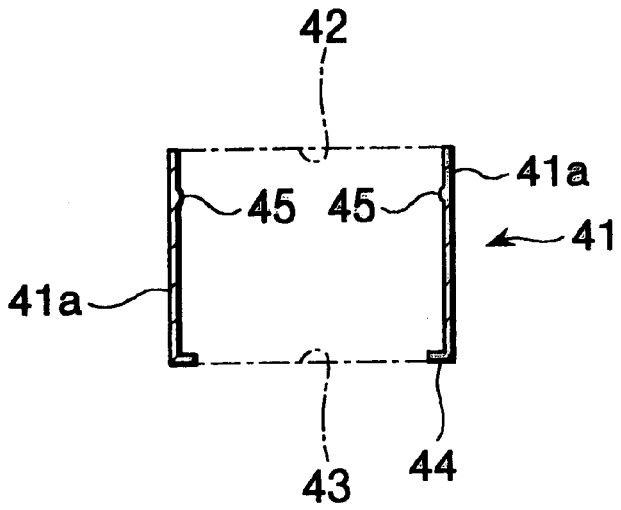
FIG. 12 is a cross-sectional view of the press-fit cap.
Figure 13:
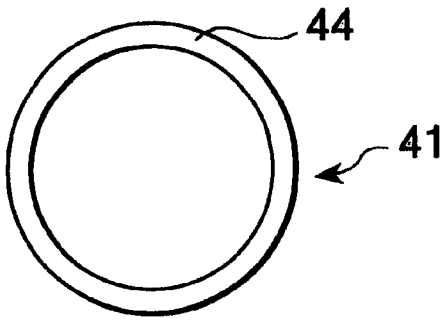
FIG. 13 is a bottom view of the press-fit cap.
Figure 14:
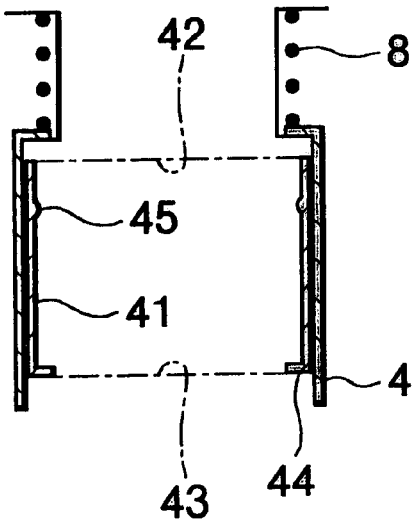
FIG. 14 is a cross-sectional view schematically showing disposition of a skirt, a spring, and the press fit cap of the stamp unit.

Next, the press fit cap 41 will be explained with reference to FIGS. 11 to 14. FIG. 11 is a plan view of the press fit cap 41. The press fit cap 41 is a substantially cylindrical shape member formed from 0.2 mm thick stainless steel plate. As shown in FIG. 12, the press fit cap 41 has a peripheral wall 41*a* and a pressing portion 44, and is formed with a second opening portion 42 and a first opening portion 43. As shown in FIGS. 12 and 13, the pressing portion 44 is formed from one side of the peripheral wall 41*a* that is bent inward by a width about 0.5 mm to 1.0 mm. The peripheral wall 41*a* is formed with a pair of protrusion portions 45 on its interior wall. The protruding portions 45 are formed simultaneously during the press process for forming the press fit cap 41. By engaging the protrusion portions 45 with the packing portions 35 of the lower main holder 3*b*, the press fit cap 41 is press fitted to the main holder 3. The press fit cap 41, once press fitted, is disposed to the immediate interior of the skirt 4 as shown in FIG. 14.

Figure 15:
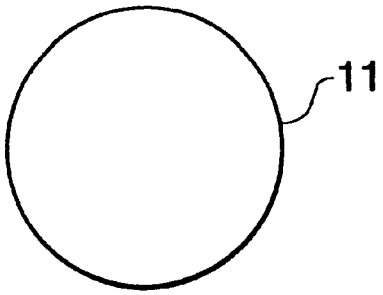
FIG. 15 is a plan view of the stamp member.
Figure 16:
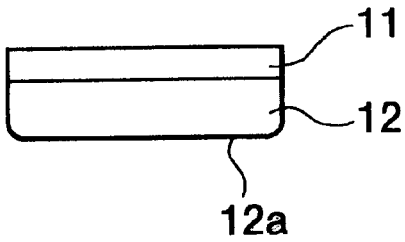
FIG. 16 is a side view of the stamp member and an ink absorbing storage body of the stamp unit.
Figure 17:
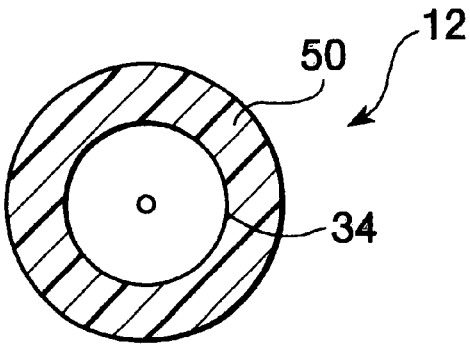
FIG. 17 is a plan view of the ink absorbing storage body.

The ink absorbing storage body 12 is formed from a stiff porous resin, such as polyvinyl formal with a porous rate of about 90%, and has a thickness of 3 mm. As shown in FIGS. 15 and 16, the stamp member 11 and the ink absorbing storage body 12 are formed in a short cylindrical shape with the bottom surfaces having the same circumference. The ink absorbing storage body 12 has a surface 12*a* that is opposite from the surface that is adhered to the stamp member 11. As shown in FIG. 17, the surface 12*a* is formed with an indentation portion 34 at its center.

Figure 18:
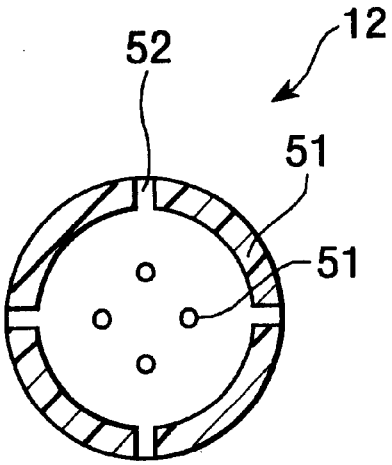
FIG. 18 is a bottom view showing the ink absorbing storage body.
Figure 19:
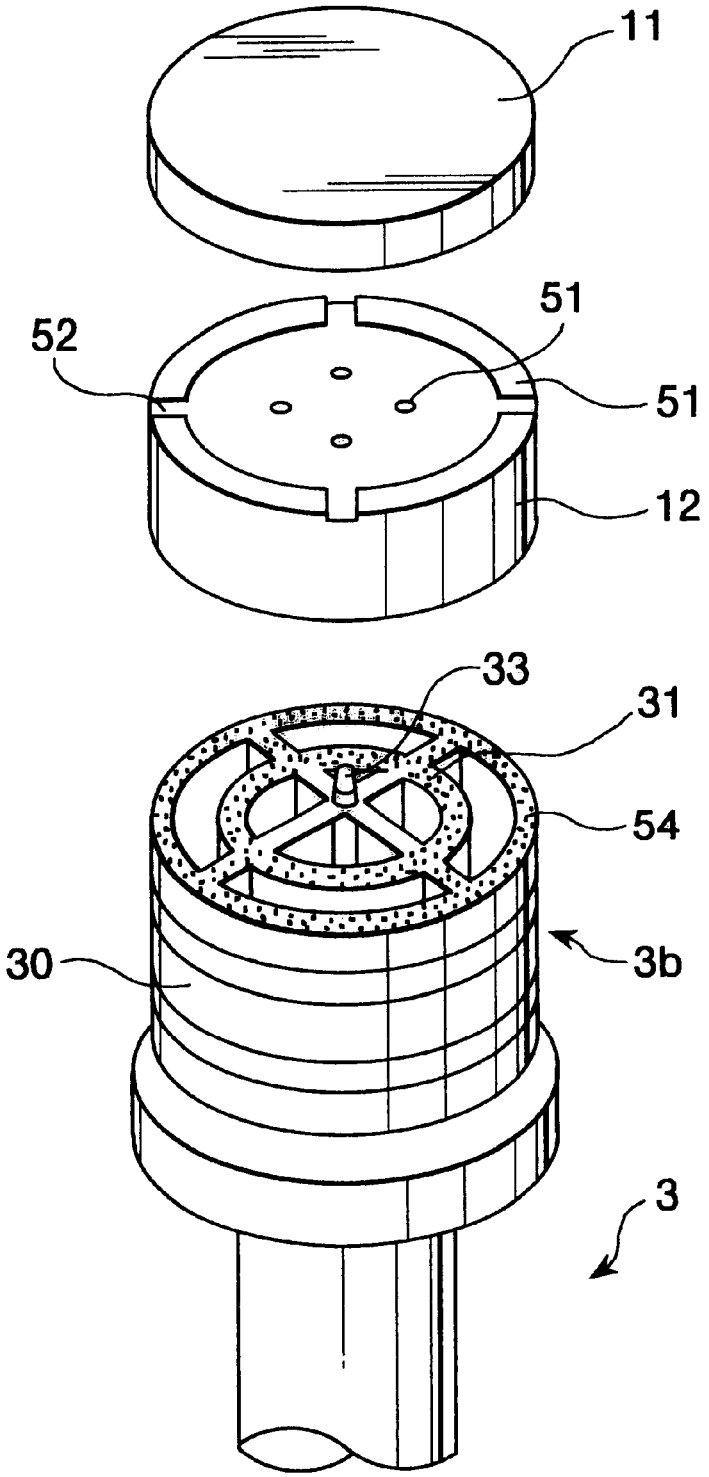
FIG. 19 is an exploded partial view roughly showing adhered order of the stamp member, the ink absorbing storage body, and the main holder.

Next, adhesion of the stamp member 11, the ink absorbing storage body 12, and the main holder 3 will be described while referring to FIGS. 17 to 21. First, adhesion of the stamp member 11 to the ink absorbing storage body 12 will be described. As shown in FIGS. 18 and 19, adhesive 51 is applied to the ink absorbing storage body 12 at four points near the center and at four circumferential regions indicated by hashing in FIG. 18. The circumferential regions are separated by non-adhered portions 52 where no adhesive is applied. Then, the ink absorbing storage body 12 is adhered to the stamp member 11.

As described above, by applying the adhesive 51 at four points near the center, the applied amount of the adhesive 51 is reduced as much as possible near the center of the stamp member 11. Therefore, the regions applied with the adhesive 51 will not appear as marks on the stamp surface 71 of the stamp member 11 after forming a stamp face. If a large amount of adhesive 51 is applied to the stamp member, then ink will not flow smoothly from the ink absorbing storage body 12 into the stamp member 11 because of the adhesive, and also ink will exude from the stamp surface 71 of the stamp member 11 only with difficulty. This degrades quality of stamped images. However, according to the present embodiment, because the adhesive 51 is applied only at the four points, quality of stamped images will not be degraded for such reasons.

Also, because the adhesive 51 is applied to the circumferential portions, the stamp member 11 will not separate from the ink absorbing storage body 12 when the film 103 is peeled from the porous resin 101. Further, because the non-adhered portions 52 are provided at four portions at the upper, lower, left, and right sides as viewed in FIG. 18, air can be discharged through the non-adhered portions 52 when the stamp member 11 is compressed at stamping. Therefore, no air will remain between the ink absorbing storage body 12 and the stamp member 11, so that ink will more quickly exude from the ink absorbing storage body 12 to the stamp face of the stamp member 11.

It should be noted that any well-known adhesive can be used as the adhesive 51. However, use of epoxy resin adhesive is particularly desirable. This is because epoxy resin adhesive has a viscosity of about 80,000 cps, and will not soak into the stamp member 11 at the center points where the adhesive is applied. It should also be noted that during actual manufacturing, it is desirable that the stamp member 11 and the ink absorbing storage body 12 be cut into a predetermined shape using a cutting pattern after the stamp member 11 and the ink absorbing storage body 12 are adhered together in the above-described manner. At this time, the pattern is fixed to the stamp member 11 and the ink absorbing storage body 12 using guide pins (not shown), no displacement of the cutting pattern will be generated with respect to an adhering pattern of the stamp member 11 and the ink absorbing storage body 12. It also should be noted that a face between the ink absorbing storage body 12 and the stamp member 11 facing and adhered each other defines an attachment face.

Figure 20:
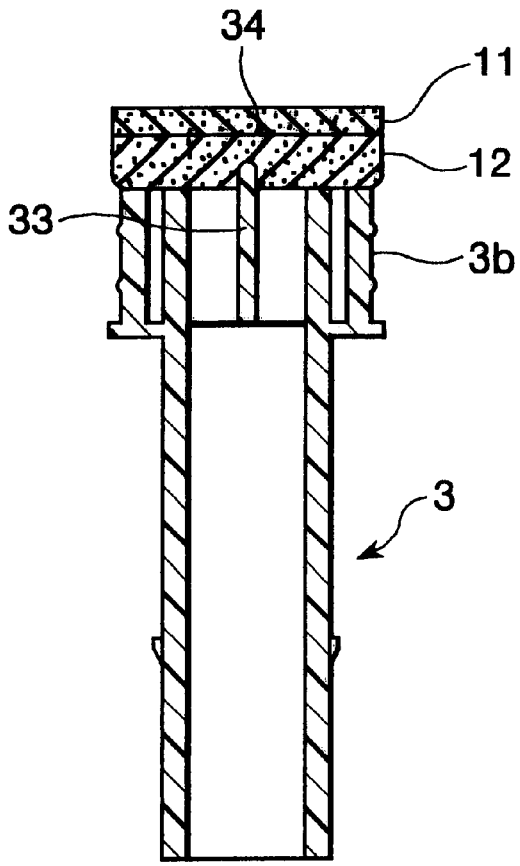
FIG. 20 is a cross-sectional view showing the stamp member, the ink absorbing storage body, and the main holder in adhered condition.
Figure 21:
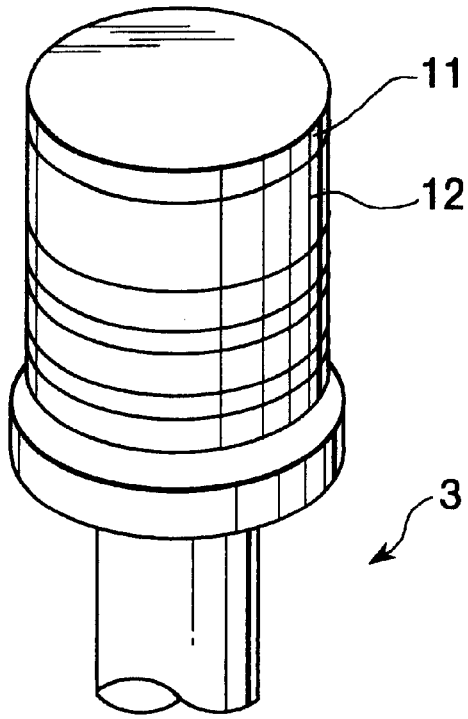
FIG. 21 is a perspective view showing the main holder adhered with the stamp member and the ink absorbing storage body.

Next, adhesion of the ink absorbing storage body 12 to the main holder 3 will be described. As shown in FIG. 17, a two sided tape 50 having a ring shape is adhered to the surface 12*a* of the ink absorbing storage body 12 at its edge portion. As shown in FIG. 19, an adhering portion 54 is formed at end surfaces of each of the supports 32, the cylindrical wall 31, and the peripheral wall 30 of the main holder 3. The ink absorbing storage body 12 is adhered to the adhering portions 54 by two sided tape 50. At this time, the protrusion 33 of the lower main holder 3*b* is inserted and engaged with the indentation portion 34 of the ink absorbing storage body 12 as shown in FIG. 20. In this way, appropriate positioning is possible between the ink absorbing storage body 12 and the main holder 3 without any positional shift. Therefore, there is no need to provide a guide member for surrounding the periphery of the stamp member 11 and the ink absorbing storage body 12 for positioning purposes, so that an excessive margin can be prevented from being generated. FIG. 21 shows the main holder 3, the stamp member 11, and the ink absorbing storage body 12 adhered together in the above manner.

Next, a method of forming a stamp face to the stamp unit 1, that is, a stamp making method, will be described while referring to FIG. 22. It should be noted that a stamp producing device and a stamp producing method used in this embodiment are substantially the same as those disclosed in Japanese Patent-Application Publication (Kokai) No. HEI-11-78912.

Figure 22:
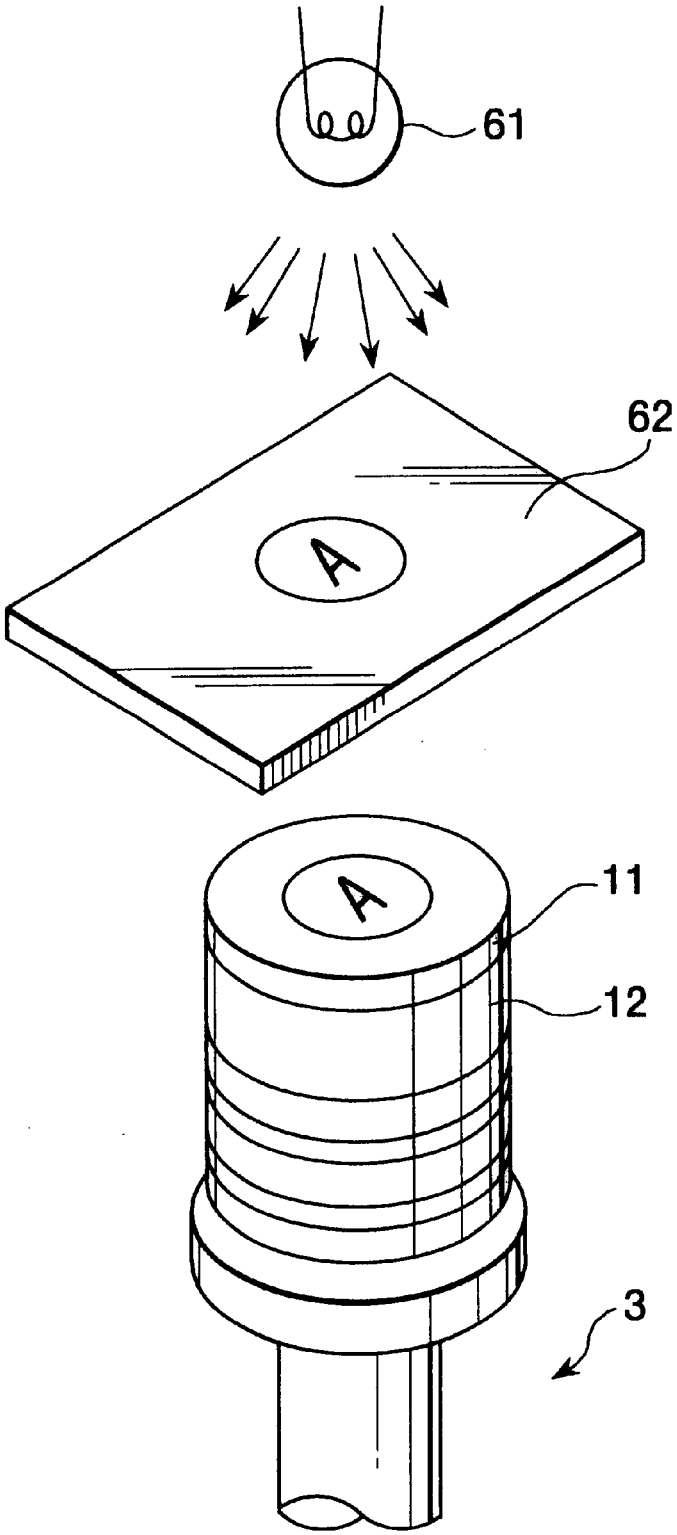
FIG. 22 is a schematic view showing a situation during stamp making.

First as shown in FIG. 22, the main holder 3 attached with the stamp member 11 and the ink absorbing storage body 12 is set in a predetermined position in a stamp producing device (not shown). Although not shown in the drawings, a roll of original transparent film, a roll of transfer ribbon, and a thermal head are provided in the stamp producing device. While transporting the original transparent film, characters or images are printed on the transparent film by the thermal head via the transfer ribbon. As a result, a positive original 62 shown in FIG. 22 is prepared and then set in a predetermined position.

Next, a xenon tube 61 of the stamp producing device is illuminated. A light from the xenon tube 61 passes through transparent portions of the positive original 62 where no characters or images are formed and irradiates the stamp member 11 at corresponding positions. Irradiated portions of the stamp member 11 are melted by thermal generating action of the light absorbing material. When emission of the light from the xenon tube 61 is stopped, these melted portions harden and become ink-non-permeable portions. On the other hand, unirradiated portions of the stamp member 11 do not melt, and become ink-permeable portions which correspond to characters and images printed on the positive original 62. As a result, the stamp surface 71 of the stamp member 11 is formed with the ink-permeable portions through which ink is exuded and the ink-non-permeable portions through which ink does not exude. The ink-non-permeable portions are formed deeper than the ink-permeable portions.

Figure 23:
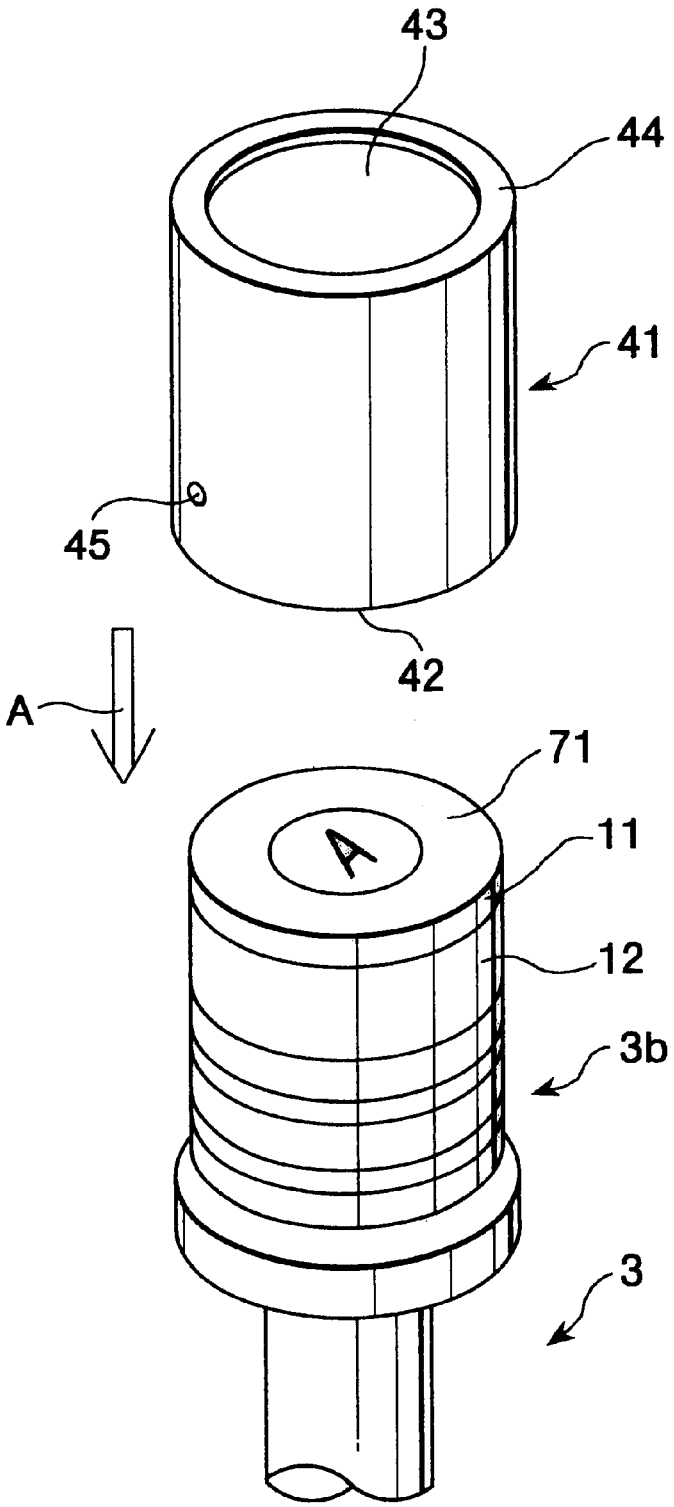
FIG. 23 is a perspective view showing the situation during press fit of the press fit cap.
Figure 24:
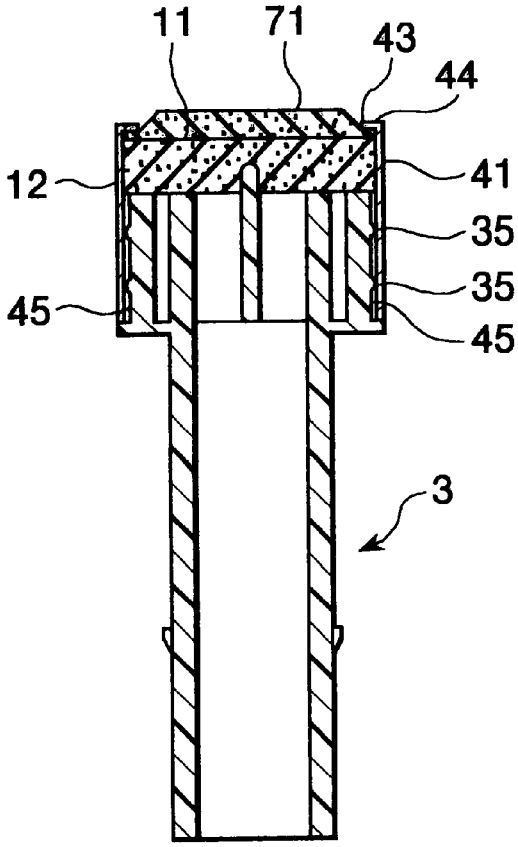
FIG. 24 is a cross-sectional view showing configuration after press fit operations.

After forming a stamp face, the film 103 is peeled from the porous resin 101. Then, as shown in FIG. 23, the press fit cap 41 is press fit in a direction indicated by an arrow A so as to cover the stamp member 11 and the ink absorbing storage body 12 by applying a force of 7 kg to 8 kg onto the press fit cap 41. The second opening portion 42 is guided to the upper end of the lower main holder 3*b,* and then, as shown in FIG. 24, the protrusion portion 45 of the press fit cap 41 and the packing portion 35 of the main holder 3 engage each other whereupon engagement between the press fit cap 41 and the main holder 3 is completed. In this way, the engagement between the protrusion 45 and the packing portion 35 operate to reliably fix the press fit cap 41, while suppressing force that operates against the press fit. Also, the engagement between the protrusion 45 and the packing portion 35 securely fix the stamp member 11 and the ink absorbing storage body 12 to the main holder 3.

A portion of the stamp member 11 that is pressed by the pressing portion 44 (hereinafter referred to as "non-stamp portion") will be a margin of the stamped image. However, because the width of the pressing portion 44 is suppressed to 0.5 mm to 1.0 mm, the margin generated because of fixing the stamp member 11 to the main holder 3 is suppressed to 0.5 mm to 1.0 mm, so the stamp can be easily aligned with the desired surface. Further, because the non-stamp portion of the stamp member 11 is compressed by the pressing portion 44, the pores formed in the non-stamp portion are closed so that ink can be prevented from leaking out by capillary action. It is desirable to compress the non-stamp portion by 0.25 mm or greater in order to effectively prevent ink from leaking.

It should be noted that such fixing can be effectively performed when the width of the pressing portion 44 is 0.5 mm or greater. However, if the width of the pressing portion 44 exceeds 1.0 mm, then the margin becomes undesirably large so that it becomes difficult to align when stamping.

Also, the stamp surface 71 of the stamp member 11 protrudes about 0.5 mm to 1.0 mm out from the first opening portion 43. When the protruding amount of the stamp surface 71 is 0.05 mm or less, stamped images may be burred. On the other hand, when the protruding amount exceeds 1.0 mm, the protruding portion of the stamp member 11 may bend and be damaged. Ink may undesirably leak out through the damaged portion.

Figure 25:
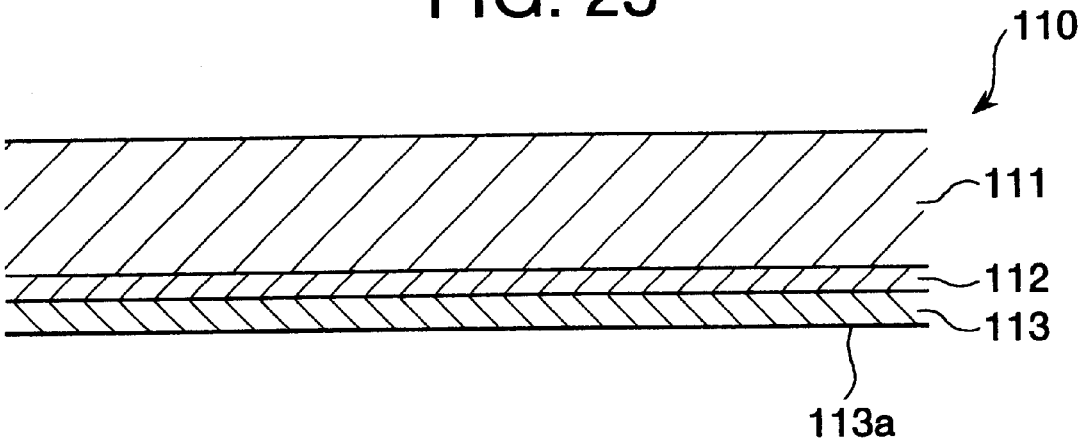
FIG. 25 is a cross-sectional view showing a stamp member according to a first modification of the present invention.

Next, a stamp member 110 according to a first modification will be described while referring to FIG. 25. The stamp member 110 is for adapted to be formed with a stamp face by a thermal head. As shown in FIG. 25, the stamp member 110 includes a porous resin 111 and a film 113 adhered together by adhesive 112. The film 113 need not be transparent.

The stamp member 110 differs from the stamp member 11 in that the thickness of the film 113 is set to 25 $\mu$m or less and in that an outer surface 113*a* of the film 113, opposite from a surface confronting the stamp member 110, has been subjected to surface processes, such as silicon coat processes. Because the film 113 has the thickness of 25 $\mu$m or less, heat from a thermal head is effectively transmitted to the porous resin 110 during forming a stamp face. Also, because the outer surface 113*a* of the film 113 has been subjected to surface processes, the thermal head can more easily slide across the film 113.

In the same manner as the stamp member 11, the porous resin 111 can be protected by the film 113 so that degradation of stamp image by dust and dirt can be prevented. Also, the amount of film 113 used can be reduced so that stamp production cost can be reduced. Also, there is no need to provide a mechanism for fixing a transparent film in confrontation with the stamp member 110 when performing an stamp making operation. This simplifies configuration of the stamp producing device.

It is desirable that the adhesive 112 have a peeling force of 0.75 kgf/cm$^2$ or less. Also, it is desirable that the adhesive 112 be acrylic type adhesive.

Figure 26:
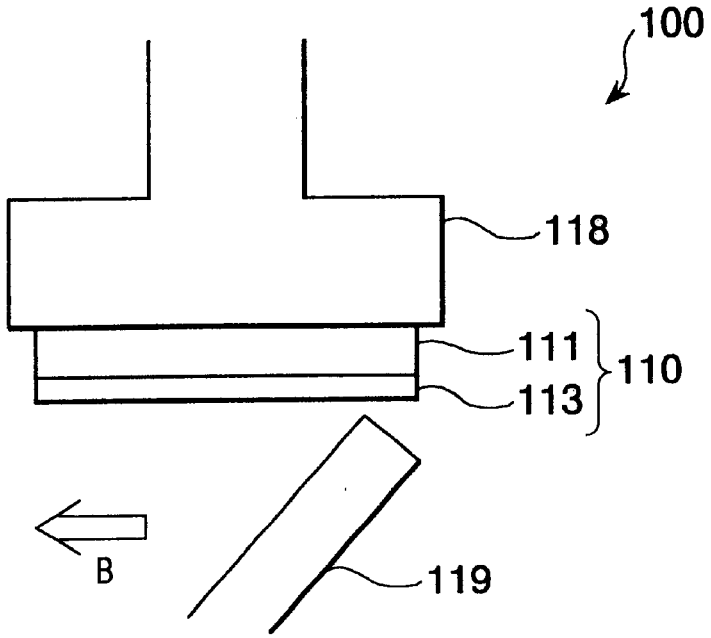
FIG. 26 is a schematic view showing situation during thermal head stamp making operation for a stamp unit provided with the stamp member of FIG. 25.

Next, stamp making processes that use a thermal head to form a stamp face in a stamp unit 100 including the stamp member 110 will be described while referring to FIG. 26. As shown in FIG. 26, the stamp unit 100 includes the stamp member 110 and a holder 118 holding the stamp member 110. First, the stamp member 110 is placed at a predetermined position. A thermal head 119 of a stamp making device is moved parallel with a surface of the stamp member 110 in a direction indicated by an arrow B while selectively heating thermal elements of the thermal head 119.

At this time, because the porous resin 111 and the film 113 are adhered together, no slippage between the porous resin 111 and the film 113 will be generated. Accordingly, a clear stamp image corresponding to an original image can be formed in the porous resin 111. Also, there is no need to interpose a transparent film between the thermal head 119 and the stamp member 110 during stamp making. This simplifies the configuration of the stamp producing device.

Figure 27:
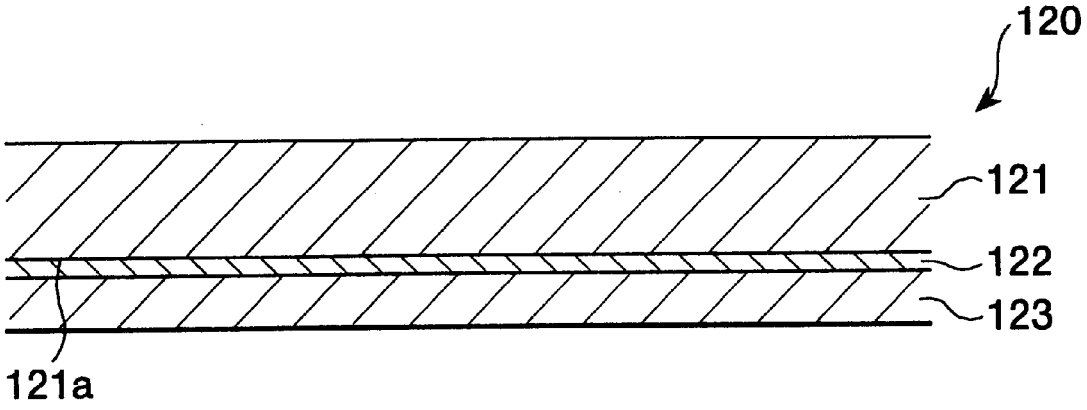
FIG. 27 is a cross-sectional view showing a stamp member according to a second modification of the present invention.

Next, a stamp member 120 according to a second modification of the present invention will be described. As shown in FIG. 27, the stamp member 120 includes a porous resin 121 and a film 123 adhered together by adhesive 122. The film 123 need not necessarily be transparent. The stamp member 120 is a member to be formed with a stamp face by a thermal plate.

The stamp member 120 differs from the stamp member 11 in that the film 123 has a thermal softening temperature of 100° C. or greater so that the film 123 does not melt when a thermal plate that is relatively high temperature contacts the film 123 during stamp making.

PET with thermal softening temperature of 160° C., PET with thermal softening temperature of 200° C., PEN with thermal softening temperature of 230° C., and polyamide with thermal softening temperature of 300° C. are materials with a thermal softening temperature of 100° C. or greater, are desirable materials for forming the film 123.

In the same manner as the stamp member 11, the porous resin 121 is protected by the film 123 so that degradation of stamp images by dust and dirt can be prevented. Also, the amount of the film 123 used can be reduced so that production costs can be reduced. Also, because the porous member 121 and the film 123 are adhered together, there is no need to provide a mechanism for placing a transparent film in confrontation with the stamp member 120 during stamp making operations. Therefore, the configuration of a stamp producing device can be simplified.

In the present embodiment also, it is desirable that the adhesive 122 has a peeling force of 0.75 kgf/cm$^2$ or less. Also, it is desirable that the adhesive 122 be an acrylic adhesive.

Figure 28:
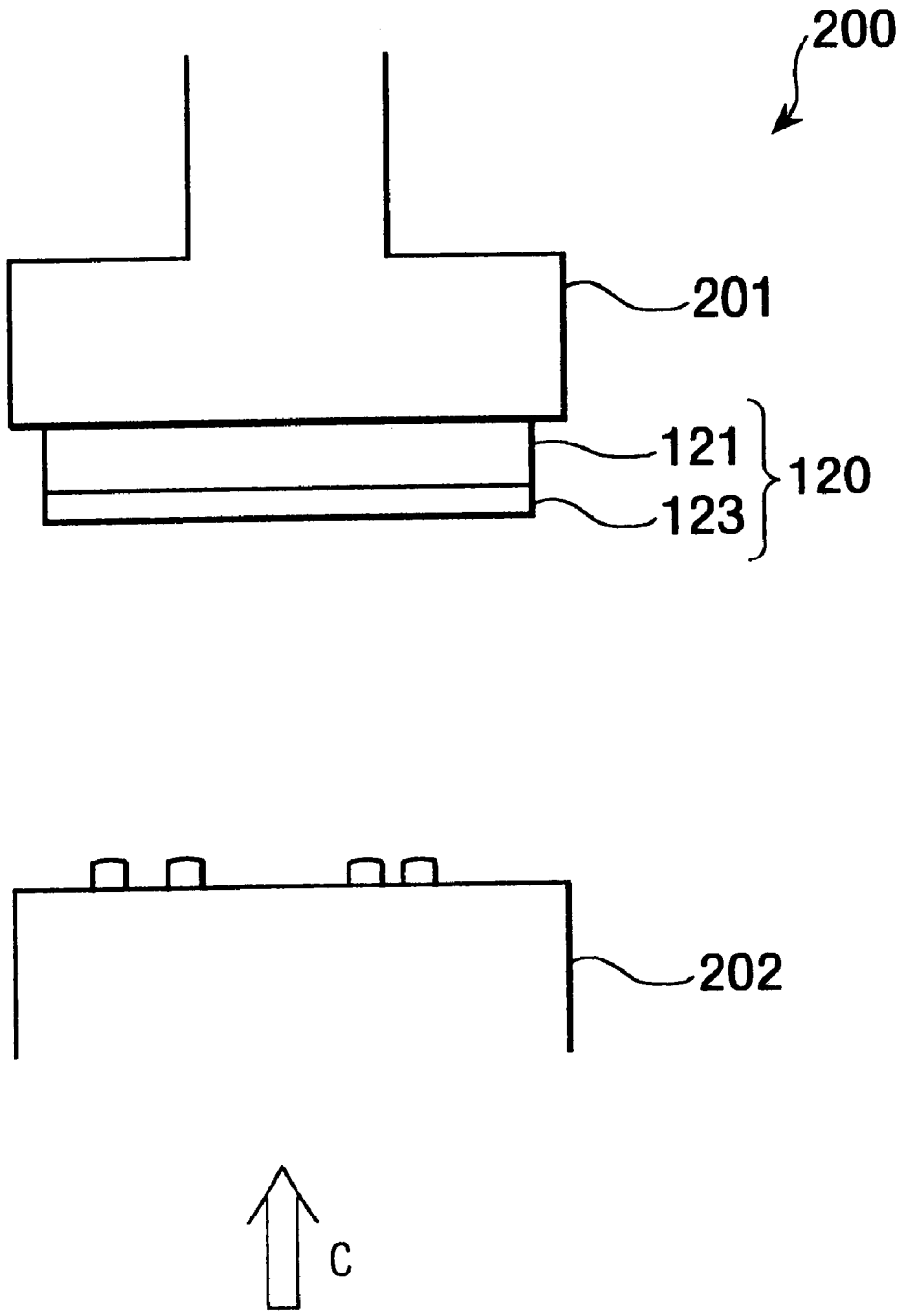
FIG. 28 is a schematic view showing a situation during thermal press stamp making of a stamp unit provided with the stamp member of the second modification.
Figure 29:
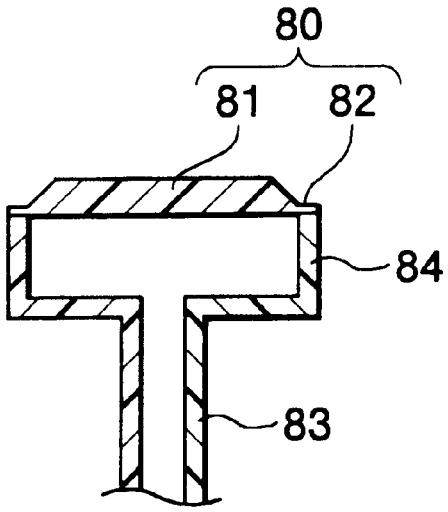
FIG. 29 PRIOR ART
FIG. 29 is a cross-sectional partial view showing a conventional stamp unit.
Figure 30:
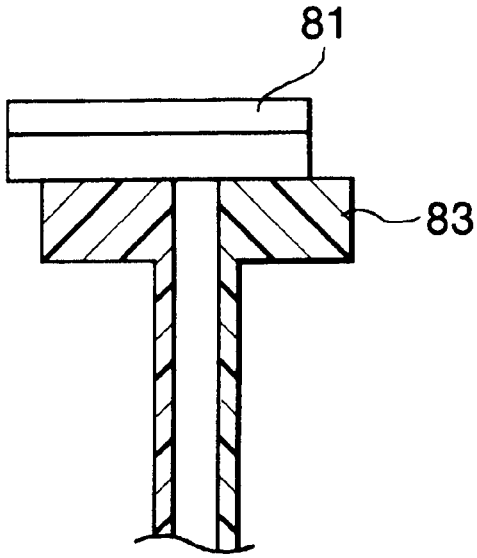
FIG. 30 PRIOR ART
FIG. 30 is a cross-sectional view showing positioning situation of a stamp member and a holder of a conventional stamp unit.
Figure 31:
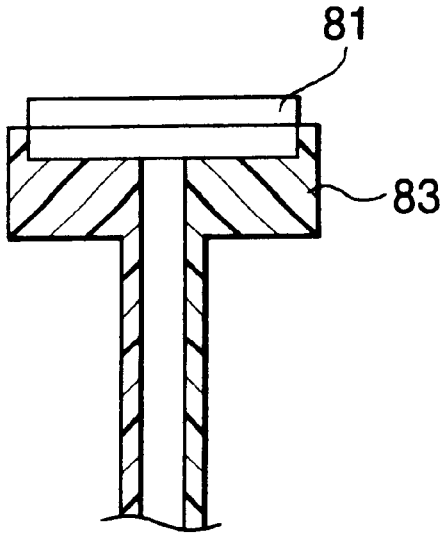
FIG. 31 PRIOR ART
FIG. 31 is a cross-sectional view showing a conceivable positioning situation of a stamp unit and a holder of a conventional stamp unit.

Next, stamp making operations for thermal press stamp making of a stamp unit 200 including the above-described stamp member 120 will be described. As shown in FIG. 28, the stamp unit 200 includes the stamp member 120 and a holder 201. A thermal plate 202 of a stamp producing device is formed with indentations and protrusions that corresponds to images. First, the stamp unit 200 is placed at a predetermined position. Then, the thermal plate 202 is moved perpendicular to the surface of the stamp member 120 in a direction indicated by an arrow C and pressed against the stamp member 120. As a result, stamp images are formed on the stamp member 120.

Next, an experiment performed using various stamp members will be described. The experiment was performed for investigating differences in the condition of the stamp face caused by different voltage values during stamp making operations, and also for investigating peeling forces of stamp members under various storage conditions. In this experiment, stamp units including different stamp members 1 to 6 were prepared. The stamp members 1 to 6 each had a circular shape 13.2 mm in diameter. The same porous resin is used in all stamp members 1 to 6. The stamp members 1 to 6 were formed with a stamp face by a flash-light stamp producing device disclosed in Japanese Patent-Application Publication (Kokai) No. HEI-11-78912 while applying different voltages. Table 1 shows conditions of each stamp member 1 to 6. The condition of resultant stamp faces are shown in Table 2. Table 3 shows the obtained peeling force, evaluation, and comments.

TABLE 1

| | film material | Film thickness (μm) | type of adhesive | coated thickness of adhesive (μm) |
|---|---|---|---|---|
| Stamp Member 1 | PET | 100 | acrylic | 15 |
| Stamp Member 2 | PVC | 50 | rubber | |
| Stamp Member 3 | PET | 45 | acrylic | |
| Stamp Member 4 | PVC | 100 | rubber | |
| Stamp Member 5 | PET | 100 | acrylic | 25 |
| Stamp Member 6 | PET | 125 | acrylic | 5 |

TABLE 2

| | Stamp Making Voltage (V) | | | | |
|---|---|---|---|---|---|
| | 260 | 285 | 300 | 315 | 330 |
| Stamp Member 1 | X | ○ | ○ | ○ | X |
| Stamp Member 2 | ○ | ○ | X | X | X |
| Stamp Member 3 | ○ | Δ | X | X | X |
| Stamp Member 4 | X | ○ | ○ | Δ | X |
| Stamp Member 5 | ○ | ○ | ○ | ○ | X |
| Stamp Member 6 | X | ○ | ○ | X | X |

TABLE 3

| | Peeling Force (gf) | | | | | | |
|---|---|---|---|---|---|---|---|
| | Directly after Sticking Together | Storage at High Temperature 60° C. | Storage at High Temperature and High Humidity 45° C. × 95% | Storage at Low Temperature −20° C. | Thermal Shift 60° C.⇔ −20° C. | Evaluation | Comment |
| Stamp Member 1 | 42–339 | 72–202 | 138–193 | 164–246 | 254–282 | ○ | |
| Stamp Member 2 | 101–172 | not executed | not executed | not executed | not executed | × | Film Thin, Small Voltage Margin |
| Stamp Member 3 | 222–331 | not executed | not executed | not executed | not executed | × | Film Thin, Small Voltage Margin |
| Stamp member 4 | 69–164 | 1000 or greater | 1000 or greater | 560–735 | 1000 or greater | × | Adhesive Moved on Stamp Surface at 60° C. at 48 Hours |

TABLE 3-continued

| | Peeling Force (gf) | | | | | | |
|---|---|---|---|---|---|---|---|
| | Directly after Sticking Together | Storage at High Temperature 60° C. | Storage at High Temperature and High Humidity 45° C. × 95% | Storage at Low Temperature −20° C. | Thermal Shift 60° C.⇔ −20° C. | Evaluation | Comment |
| Stamp member 5 | 89–264 | 151–253 | 173–253 | 222–307 | 429–500 | ○ | |
| Stamp Member 6 | 54–143 | 90–104 | 55–71 | 72–137 | 169–189 | ○ | |

In Table 2, ○ represents that a stamp image was properly formed on the stamp member surface, Δ represents that a stamp image was fairly well formed on the stamp member surface, and X represents that a stamp image was not properly formed on the stamp member surface. A large voltage margin for the stamp marking voltage is desirable. In concrete terms, the larger the range of voltages indicated by ○, the better.

Regarding Table 3, each stamp member 1 to 6 was stored at several different conditions, that is, at a high temperature of 60° C. for 240 hours, at a high temperature of 60° C. and high humidity of 95% humidity for 240 hours, at a low temperature of −20° C. for 240 hours, and at 24-hour thermal shift, that is, repeatedly alternately at 60° C. and −20° C. each for 1 hour. Data was not measured for empty column portions of Table 3.

From the experimental results shown in Tables 1 to 3, the following points can understood. The stamp members 2 and 3 have a relatively small voltage margins. This is because the stamp members 2 and 3 have a film with a small thickness of 50 $\mu$m or less. The film with such a small thickness has only slight thermal insulation effects, thereby degrading the stamp image.

Also, the peeling force of the rubber adhesive used in the stamp member 4 initially had a peeling force of 69 gf to 164 gf. However, the peeling force of the rubber adhesive became 1000 gf, that is, 0.75 kgf/cm$^2$, or greater under all storage conditions. Moreover, it was observed that the rubber adhesive of the stamp member 4 had moved onto a porous resin surface under these storage conditions. Therefore, it could be understood that rubber adhesive is inappropriate for use in stamp members.

On the other hand, peeling force of acrylic adhesive used in the stamp members 1, 5, 6, which had a low initial peeling force, never reached or exceeded 1000 gf, that is 0.75 kgf/cm$^2$, regardless of the storage condition. That is, a porous resin and a film can be stored for a long period of time when these two are adhered together by acrylic resin. Accordingly, acrylic adhesive is appropriate for long term storage.

While some exemplary embodiments of the present invention have been described in detail, those skilled in the art will recognize that there are many possible modifications and variations which may be made in these exemplary embodiments while yet retaining many of the novel features and advantages of the invention.

For example, in the above-described embodiment, non adhering portions 52 for air bleeding purposes are provided at four positions. However, these could be provided in any optional number, such as at one position, two positions, three positions, or six positions. Also, a pair of protrusion portions 45 are provided in the above-described embodiment. However, any optional number of protrusion portion can be provided, such as three protrusion portions or four protrusion portions.

Further, according to the above-described present embodiment, the main holder 3 is formed from polypropylene. However, the main holder 3 could be formed from any one of polycarbonate, or polyolefin type resin, such as nylon, polyethylene, polyacetal copolymer, and a ABS resin.

What is claimed is:

1. A stamp unit comprising:

a stamp member;

a support member that supports the stamp member; and a fixing member that fixes the stamp member to the support member, the stamp member comprising a porous resin having a surface, and a film adhered to the surface of the porous resin for protecting the surface, the film being separable from the porous resin without damaging the surface of the porous resin, the film being adhered to the surface of the porous resin with peeling force of 0.001 kgf/cm$^2$ to 0.75 kgf/cm$^2$, the film being adhered to the surface of the porous resin by an acrylic adhesive, the surface of the porous resin being formed with ink-non-permeable portions and ink-permeable portions by one of flash light stamp making operations, thermal head stamp making operations, and thermal press stamp making operations, the ink-non-permeable portion being formed deeper than the ink-permeable portions, the fixing member fixing the stamp member to the support member by pressing a portion of the ink-non-permeable portions formed to an edge portion of the surface of the porous resin, the fixing member including a pressing member that presses the portion of the ink-non-permeable portions, the pressing member defining an opening through which the ink-permeable portions of the porous resin protrude outward, the fixing member further including a cylindrical cap having an interior surface formed with at least two protrusions, and the support member is formed with at least two engaging portions each for engaging respective one of the at least two protrusions of the cylindrical cap, the support member being fitted interior of the cylindrical cap.

2. A stamp unit comprising:

a stamp member;

a support member that supports the stamp member;

a fixing member that fixes the stamp member to the support member; and an ink absorbing storage body provided between the stamp member and the support member, the stamp member comprising a porous resin having a surface, and a film adhered to the surface of the porous resin for protecting the surface, the film being separable from the porous resin without damaging the surface of the porous resin, the film being adhered to the surface of the porous resin with peeling force of 0.001 kgf/cm$^2$ to 0.75 kgf/cm$^2$, the film being adhered to the surface of the porous resin by an acrylic adhesive, the surface of the porous resin being formed with ink-non-permeable portions and ink-permeable portions by one of flash light stamp making operations, thermal head stamp making operations, and thermal press stamp making operations, the ink-non-permeable portion being formed deeper than the ink-permeable portions, the fixing member fixing the stamp member to the support member by pressing a portion of the ink-non-permeable portions formed to an edge portion of the surface of the porous resin, the ink absorbing storage body having an upper surface, wherein the stamp member has another surface opposite from the surface, and the another surface of the stamp member and the upper surface of the ink absorbing storage body are adhered together by an adhesive, thereby defining an attachment face between the stamp member and the ink absorbing storage body, the adhesive being applied to a portion of an edge of the attachment face to define at least one non-adhering portion at the edge for discharging air trapped between the stamp member and the ink absorbing storage body.

3. The stamp unit according to claim 2, wherein the stamp member has another surface opposite from the surface, and the another surface of the stamp member and the upper surface of the ink absorbing storage body are adhered together by an adhesive applied at a plurality of points near the center of the attachment face.

4. The stamp unit according to claim 3, wherein the ink absorbing storage body has a lower surface formed with an indentation, and the support member is formed with a protrusion for engaging the indentation of the ink absorbing storage body.

* * * * *